United States Patent [19]

Brill

[11] Patent Number: 4,580,784

[45] Date of Patent: Apr. 8, 1986

[54] GOLF CLUB INCLUDING BALL RETRIEVING DEVICES

[76] Inventor: Edward F. Brill, 5150 Lake Shore Dr., Oconomowoc, Wis. 53066

[21] Appl. No.: 630,385

[22] Filed: Jul. 13, 1984

[51] Int. Cl.[4] ..... A63B 53/04

[52] U.S. Cl. ..... 273/162 E; 294/19.2; 273/169; 273/164

[58] Field of Search ..... 273/162 D, 162 E, 32 F, 273/169, 164; 294/19 A

[56] References Cited

U.S. PATENT DOCUMENTS

| | | | |
|---|---|---|---|
| D. 242,479 | 11/1976 | Panek | D21/214 |
| 1,960,110 | 5/1934 | Iles | 273/162 D |
| 2,465,124 | 3/1949 | Quattrin | 273/193 R |
| 3,300,241 | 1/1967 | Eberwin et al. | 294/19 A X |
| 3,374,027 | 3/1968 | Jacobs | 294/19 A |
| 3,632,112 | 1/1972 | Jacobs | 273/162 D |
| 3,708,172 | 1/1973 | Rango | 273/164 |
| 3,779,398 | 12/1973 | Hunter | 273/183 D |
| 3,841,639 | 10/1974 | Werner | 273/162 E |
| 3,944,231 | 3/1976 | Johnson | 273/162 E |
| 4,248,430 | 2/1981 | Kepler | 273/162 D |
| 4,361,329 | 11/1982 | Brock | 273/162 E |

*Primary Examiner*—George J. Marlo

*Attorney, Agent, or Firm*—Andrus, Sceales, Starke & Sawall

[57] ABSTRACT

A golf club capable of retreiving a golf ball by frictionally gripping the ball, or by scooping the ball from a surface. The head of the golf club includes a front section having a front face adapted to strike a golf ball, and a pair of side sections extend rearwardly from the front section. The side sections have spaced parallel side edges which define a recess. The distance between the side edges is substantially equal to the diameter of a golf ball, so that by pushing the head downwardly against the ball, the ball will enter the recess and be gripped by the side edges, to retrieved from the cup or green. Each side section of the club head is provided with a generally concave surface which extends upwardly from the respective side edge and the concave surfaces define a cradle. By moving the club head in a backward direction, the ball can be scooped into the cradle from the putting green or other surface and retrieved.

10 Claims, 6 Drawing Figures

FIG. 1
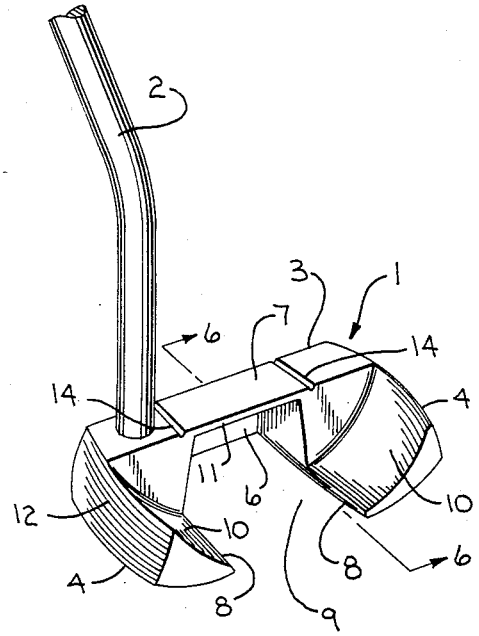
FIG. 2
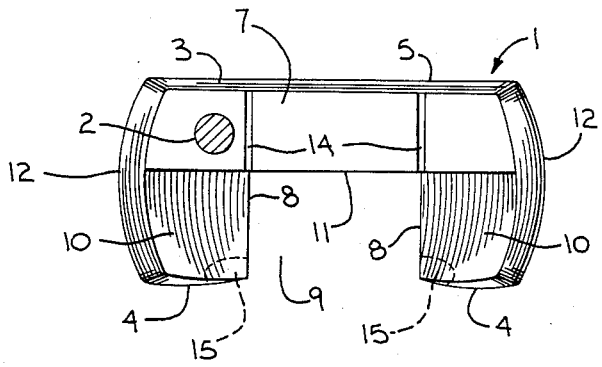
FIG. 3
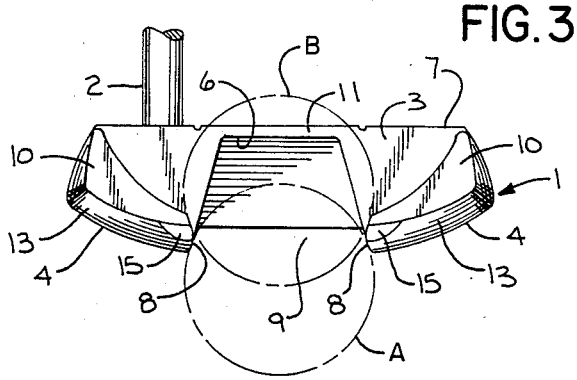
FIG. 4
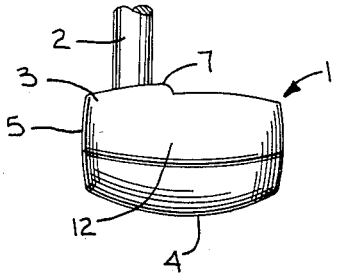
FIG. 5
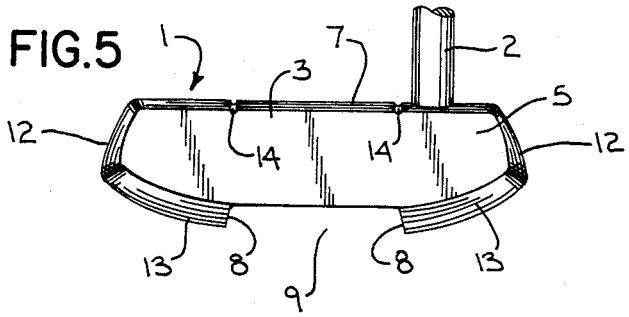
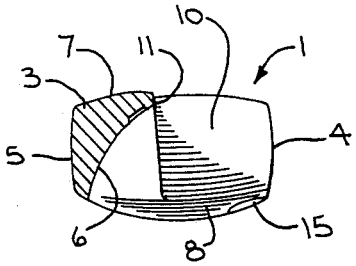
FIG. 6

GOLF CLUB INCLUDING BALL RETRIEVING DEVICES

BACKGROUND OF THE INVENTION

It is convenient for a golfer to be able to retrieve a golf ball from a putting green without the necessity of bending over and picking the ball from the green or from the cup. In the past, certain golf clubs have been constructed with the capability of scooping the ball from the green by moving the club head in a backward stroke, while other golf clubs have been constructed with the capability of frictionally gripping the ball to enable the ball to be retrieved from the green or the cup. For example, U.S. Pat. Nos. 3,944,231 and 4,248,430 show golf clubs having recesses or cavities in the rear portion which enables the ball to be scooped from the green with a backward motion of the club head. U.S. Pat. Nos. 3,300,241, 3,841,639, 2,465,124, 3,632,112, and 3,374,027 show golf clubs constructed so that the ball can be frictionally gripped by pushing the club head down on the ball to thereby retrieve the ball from the green or the cup. Howver, no golf club has been designed with the combined capability to scoop a ball from the green, as well as frictionally gripping the ball to retrieve the ball from the cup.

SUMMARY OF THE INVENTION

The invention is directed to a golf club having the combined capability of retrieving a ball by frictionally gripping the ball or scooping the ball from a green or other surface.

In accordance with the invention, the head of the golf club is composed of a front section having a front face adapted to strike the golf ball, and a pair of side sections extend rearwardly in spaced relation from the ends of the front section. The side sections of the club head are provided with spaced, parallel, gripping edges which define a recess in the sole of the head. The width of the recess, i.e. the distance between the spaced side edges, is substantially equal to, or slightly less than, the diameter of the golf ball, so that by pushing downwardly on the head against the ball, the ball will enter the recess and be frictionally gripped by the side edges to retain the ball.

Each side section of the club head also includes a generally concave surface which extends upwardly and outwardly from the respective side gripping edge and the concave surfaces in combination define a cradle to receive the ball as the club is moved across the green with a backward scooping motion. The concave surfaces are sloped downwardly toward the front section, so that the ball will rest against the forward section of the club head to prevent displacement of the ball from the cradle.

The golf club of the invention has the capability of removing the ball from the cup or the putting green by frictional gripping the ball, or alternately retrieving the ball by a backward scooping action. Because of the roughened upwardly converging gripping edges, the club will positively grip both the larger diameter United States ball, as well as the smaller diameter British ball.

As a further feature of the invention, the back surface of the front section of the club head is provided with a curved cavity or arch which communicates with the recess between the side sections. Because of the arch, the maximum weight is located at the heel and toe extremities of the club head, thereby providing maximum inertia and minimizing club twisting if the ball is hit off center.

The construction of the invention, having extreme heel and toe weighting provides a low center of gravity and balance about a broadened sweet spot.

As a further aspect of the invention, the top surface of the front section of the club head is provided with a pair of aiming lines or guidelines which are aligned with the respective gripping edges. The aiming lines, being perpendicular to the line of putting provide accurate aiming and centering of the ball on the sweet spot to achieve smooth stroking and follow through of the club head.

The front face of the club head is slightly convex in a vertical direction to maintain longer ball-face contact, thereby resulting in overspin on the ball.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the golf club of the invention;

FIG. 2 is a top plan view of the club head;

FIG. 3 is a rear elevation of the club head;

FIG. 4 is an end view of the club head;

FIG. 5 is a front view of the club head; and

FIG. 6 is a section taken along line 6—6 of FIG. 1.

DESCRIPTION OF THE PREFERRED EMBODIMENT

The drawings illustrate a golf club having the combined capability of retrieving a golf ball by frictionally gripping the ball, as well as retrieving the ball by scooping the ball from a surface.

The golf club includes a head 1 made of a rigid material, such as metal, plastic or the like, which is secured to the hosel 2 or the shaft. Head 1 includes a front section 3 and a pair of side sections 4 which extend rearwardly from the front section, as best illustrated in FIG. 1.

Front section 3 includes a front face 5 which is adapted to strike the golf ball. As shown in FIG. 6, the front face 5 is slightly convex in a vertical direction which maintains the face in contact with the ball for a longer period of time and imparts overspin to the ball.

As shown in FIGS. 1 and 6, the rear portion of front section 3 is formed with an arch or cavity 6 which terminates just short of top surface 7. The arch serves to concentrate weight at the heel and toe, thereby providing maximum inertia and minimizing club twisting if the ball is hit off center.

Each side section 4 is provided with a side edge 8 and as illustrated in FIGS. 2 and 3, side edges 8 are generally parallel and diverge downwardly at an angle of about 10° to the vertical. Side edges 8 define a recess 9.

Edges 8 are roughened by providing the surfaces with knurls, ribs, or other surface deviations to increase the frictional contact with the ball. As best shown in FIG. 3, the distance across the recess 9, i.e. or the distance between the side edges 8, is substantially equal to or slightly less than the diameter of the ball. When the club head is pushed downwardly on the ball, the ball, shown by the phantom lines A in FIG. 3, will enter recess 9 and be gripped by the edges 8, thereby holding the ball and enabling the ball to be retrieved from the green or the cup. Due to the diverging side edges, the club is capable of frictionally gripping both the larger diameter United States ball and the smaller diameter British ball.

Each side section 4 is formed with a generally concave upwardly extending surface 10 which extends upwardly and outwardly from the respective side edge 8. The two concave surfaces 10 in combination provide a cradle to receive the ball, as shown by the phantom line B in FIG. 3, when the ball is scooped from a surface by backward motion of the club head. When resting in the cradle, the ball will bear against the rear edge 11 of front section 3. This will prevent the ball from being displaced as it is being scooped from the green.

It is contemplated that the length of the head 1, from heel to toe, is less than the diameter of a cup on a putting green, so that the head can be inserted into the cup to retrieve the ball. In this regard, the side edges 12 of the head are curved in a manner to conform to the curvature of the cup. In addition, the bottom surface of the head, shown by 13, is curved to conform to the beveled surface at the bottom of the cup to thereby enable the ball to be retrieved from the cup.

As a further feature of the invention, the top surface 7 of the section 3 is provided with a pair of guide or aiming lines 14. As shown in FIG. 2, the lines 14 are in alignment with the respective side edges 8. When viewing from the top, the aiming lines 14 provide accurate aiming and centering of the ball on the sweet spot for smoother stroking and follow through of the club head.

As the gripping edges extend from the rear of the head through the arch 6 to adjacent the front face 5, greater range is provided and it is not necessary to precisely center the club head over the ball in order to grip the ball.

To aid in positioning the ball in the recess 9, the bottom surface or sole of each side section 4 can be provided with a concave recess 15.

It is also contemplated that weights or plugs, not shown, can be inserted into the back of each side section 4 and retained therein. By proper selection of the weights, the club head can be individually balanced and weighted to meet the individual golfers requirements.

Various modes of carrying out the invention are contemplated as being within the scope of the following claims particularly pointing out and distinctly claiming the subject matter which is regarded as the invention.

I claim:

1. In a golf club, a head including a front section having a front face adapted to engage a golf ball, and a pair of side sections extending rearwardly in spaced relation from said front section, said side sections having spaced parallel side edges extending in a front to rear direction and defining a recess, said recess opening to the bottom of said head and the distance between said side edges being substantially equal to the diameter of a golf ball so that a golf ball can be frictionally gripped between said side edges when said club is pushed downwardly against said ball, each side section having a surface extending upwardly and outwardly lateral from said respective side edge with said surfaces defining a cradle adapted to receive a golf ball being scooped from a surface by backward movement of the club head.

2. The golf club of claim 1, wherein each of said surfaces is upwardly concave.

3. The golf club of claim 2, wherein each of said surfaces slopes downwardly in a direction toward said front section, whereby a golf ball received in said cradle will rest against the rear surface of said front section.

4. The golf club of claim 1, wherein the bottom of said front section is provided with a central arch which communicates with said recess, said side edges extending into said arch.

5. The golf club of claim 1, wherein said side edges diverge downwardly and are roughened to aid in frictionally gripping the golf ball.

6. The golf club of claim 1, wherein the bottom surface of each side section extending laterally from each side edge is curved upwardly and outwardly.

7. The golf club of claim 1, wherein the bottom surface of each side section is provided with a concavity, each concavity being locacted adjacent the rear end of the respective side edge.

8. In a golf club, a head including a front section having a front face adapted to engage a golf ball, and a pair of side sections extending rearwardly in spaced parallel relation from said front section, said side sections having spaced side edges extending in a front to rear direction and defining a recess, said side edges diverging downwardly and outwardly in a lateral direction, said recess opening to the bottom of said head and the distance between said side edges being substantially equal to the diameter of a golf ball so that a golf ball can be frictionally gripped between said side edges when said club is pushed downwardly against said ball, each side section having a concave surface extending laterally upwardly and outwardly from the respective side edges, the rear portion of said front section located between said side sections having a central arch, said arch extending upwardly and rearwardly in a front to rear direction and communicating with said recess.

9. The golf club of claim 8, wherein said arch is concave.

10. In a golf club, a head including a front section having a front face adapted to engage a golf ball, and a pair of side sections extending rearwardly in spaced parallel relation from said front section, said side sections having spaced generally parallel opposed edges spaced apart a sufficient distance to grip a golf ball when the club is pushed downwardly on said ball, each side section having a surface extending laterally upwardly and outwardly from the respective edge, said surfaces in combination defining a cradle adapted to receive a golf ball being scooped from a surface by backward movement of the club head, said surfaces sloping downward in a direction toward said front section, the rear portion of said front section located between said side sections having a central arch, said arch extending upwardly and rearwardly and communicating with said recess.

* * * * *